US007735745B2

(12) United States Patent
Igwenezie

(10) Patent No.: US 7,735,745 B2
(45) Date of Patent: Jun. 15, 2010

(54) DEVICE FOR JOINING RAILS

(76) Inventor: Jude Odihachukwunma Igwenezie, 2 Ravencroff Circle, Brampton, ON (CA) LGZ4P3

( * ) Notice: Subject to any disclaimer, the term of this patent is extended or adjusted under 35 U.S.C. 154(b) by 567 days.

(21) Appl. No.: 11/570,773

(22) PCT Filed: Jun. 16, 2005

(86) PCT No.: PCT/CA2005/000946

§ 371 (c)(1),
(2), (4) Date: Dec. 17, 2006

(87) PCT Pub. No.: WO2005/122674

PCT Pub. Date: Dec. 29, 2005

(65) Prior Publication Data

US 2008/0035749 A1 Feb. 14, 2008

Related U.S. Application Data

(60) Provisional application No. 60/580,091, filed on Jun. 17, 2004, provisional application No. 60/627,949, filed on Nov. 16, 2004.

(51) Int. Cl.
*E01B 11/00* (2006.01)

(52) U.S. Cl. ..... 238/159; 238/243; 238/248

(58) Field of Classification Search ..... 238/159, 238/243, 248
See application file for complete search history.

(56) References Cited

U.S. PATENT DOCUMENTS 2,441,329 A * 5/1948 Payne ..... 238/155
2,628,784 A * 2/1953 Payne ..... 238/155
2,670,136 A * 2/1954 Moses ..... 238/155
2,808,996 A * 10/1957 Delfox ..... 238/208
3,416,728 A * 12/1968 Hamilton, Jr. ..... 238/152
3,658,245 A * 4/1972 Nelson ..... 238/151
3,698,634 A * 10/1972 Hamilton, Jr. ..... 238/152
3,910,492 A * 10/1975 Sinfield ..... 238/243
3,952,948 A * 4/1976 Nelson et al. ..... 238/243
4,105,160 A * 8/1978 Ramer ..... 238/167
4,378,909 A * 4/1983 Oger ..... 238/244
4,466,570 A * 8/1984 Howard ..... 238/153
4,485,967 A * 12/1984 Edwards ..... 238/226
7,097,112 B2 * 8/2006 Urmson et al. ..... 238/243
2006/0027674 A1 * 2/2006 Urmson et al. ..... 238/243
2007/0034706 A1 * 2/2007 Urmson et al. ..... 238/243
2008/0035749 A1 * 2/2008 Igwenezie ..... 238/243
2009/0121037 A1 * 5/2009 Urmson et al. ..... 238/243

FOREIGN PATENT DOCUMENTS

EP 268239 A2 * 5/1988

* cited by examiner

*Primary Examiner*—S. Joseph Morano
*Assistant Examiner*—Jason C Smith
(74) *Attorney, Agent, or Firm*—Furr Law Firm; Jeffrey Furr, Esq.

(57) ABSTRACT

The present invention is directed at an improved device for joining together abutting railway rails between two railway ties. The rails to be joined together have a head portion, a web portion and a toe portion. The joining device includes first and second elongated metal joint bars for holding the abutting ends of the rails together. The joint bars span the ends of the rails and hold the rails together by mounting to the rails. The joint bars are mounted to each rail on opposite sides of the web portions of each rail. The joint bars are configured to mount to the web portions of the rail between the head and toe portion of each rail.

11 Claims, 16 Drawing Sheets

7
56
18
25
54
9
19
54
25

48
1
56
44
44
8
1
46
48
50
7
54
58
9
54

46
66
52
66
62
7
58
60
9
58
48
60

DETAIL A 33
28
31

10a
27a
26a
3a
6a
29a
30a
SECTION A-A
SCALE 1:3

A
A

DEVICE FOR JOINING RAILS

CROSS REFERENCE TO RELATED APPLICATION

This application claims priority from U.S. Provisional patent application Ser. Nos. 60/580,091 filed Jun. 17, 2004, and 60/627,949 filed Nov. 16, 2004, the entirety of which applications are incorporated herein by reference.

TECHNICAL FIELD

The invention relates generally to devices for joining or splicing railroad rails.

BACKGROUND ART

Referring to FIG. 1, rail joints comprise of the two rails (1) connected together by a pair of joint (splice) bars (2) and a set of nuts (3) and bolts (4). Together they form the assembly shown in FIG. 1. Since their invention, rail joints have been a weakness in the railway track system. The joint is weaker than the rail section because the bending strength reflected by the section modulus of the two joint bars used at a joint is only a fraction (between twenty percent (20%) and thirty percent (30%)) of the section modulus of the rail section. The weaker joint section causes poor load distribution to the ties, excessive deflection of the rail and pumping of the track. To address this problem, railways worldwide adopted continuously welded rails, which in turn have their own set of problems. Unfortunately, we still need some joints in our system in order to separate the track into signal blocks. The signal bocks allow the train dispatcher to locate trains along the track. The signal blocks are also used for switching of the trains from one track to another and for rail break detection. For each signal block to work efficiently, the rails at adjacent blocks must be electrically isolated from one another.

Along came insulated joints (IJs) such as shown in FIG. 2. These joints have insulating materials (5) between the joint bars (6) and the rail (1) and between the bolts (4) and the rail (1) to ensure that, the two rails at the joint are electrically isolated from one another. Unfortunately, the insulator (5) is the Achilles heel of the IJ system. The polymer material cannot stand the contact and bending stresses from the passage of the train wheels. The problem is worsened by thermal stresses that arise from temperature swings. If the insulating material (5) is made from soft polymer such as rubber, it will cause the joint to flex excessively, loosen the bolts. The polymer will also ooze out at high temperatures. If the polymer is hard enough to maintain its molecular structure at high temperatures, it will be brittle in the winter months and unzip by brittle shear cracking. In either case, the strength of the joint and the excess displacement due to its geometry are not addressed.

In recent times, railways worldwide are pushing for Positive Train Control (PTC) systems that utilize Geo Positioning Satellites (GPS) to move trains. This will reduce the number of locomotive engineers required to operate a train. To ensure that switches are positively locked and lined up with the mainline requires that sturdier and better IJs be designed. Introduction of PTC in a dark territory will necessitate the use of IJs at all switches along the line for the same reason. This salient issue might surface in a few years reinforcing the fact that IJs are here to stay at least for the near term.

DISCLOSURE OF THE INVENTION

The present invention is directed at an improved device for joining together abutting railway rails between two railway ties. The rails to be joined together have a head portion, a web portion and a toe portion. The joining device includes first and second elongated metal joint bars for holding the abutting ends of the rails together. The joint bars span the ends of the rails and hold the rails together by mounting to the rails. The joint bars are mounted to each rail on opposite sides of the web portions of each rail. The joint bars are configured to mount to the web portions of the rail between the head and toe portion of each rail. The joining device further includes first and second stiffener plates mounted to the first and second joint bars, respectively, such that the joint bars and the web portion of the rails are sandwiched between the stiffener plates. The stiffener plates each having a top portion, a bottom portion and opposite lower ends. The stiffener plates span the abutting ends of the rail. The bottom portion of the stiffener plates are dimensioned and configured to extend below the toe portion of the rails and the opposite lower ends of the stiffener plates are notched to accommodate the ties.

BRIEF DESCRIPTION OF DRAWINGS

In the drawings, like characters of reference indicate corresponding parts in the different figures.

BEST MODE FOR CARRYING OUT THE INVENTION

Figure 1A:
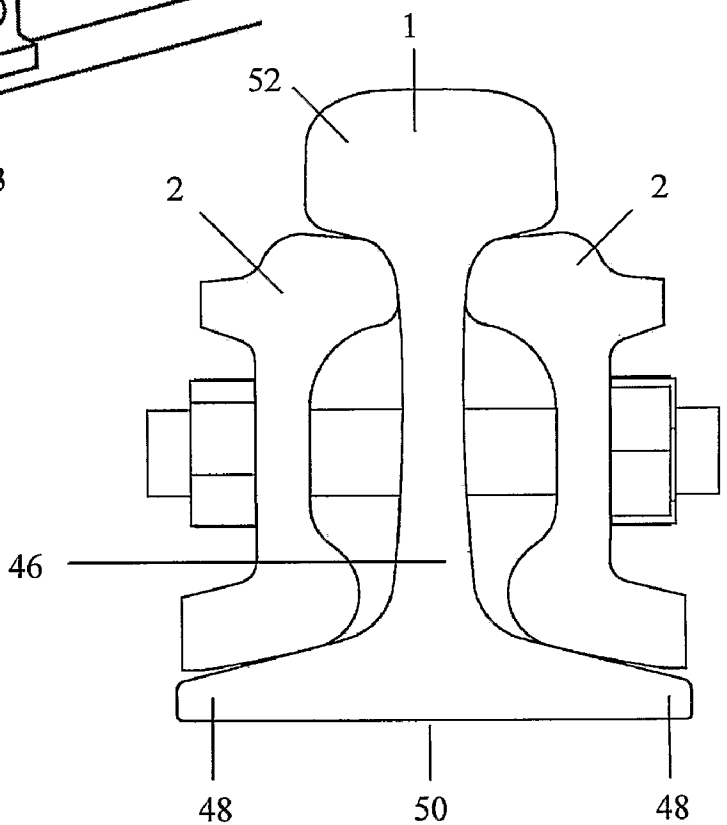
FIG. 1*a* is a cross sectional view of the joint system shown in FIG. 1.
Figure 1:
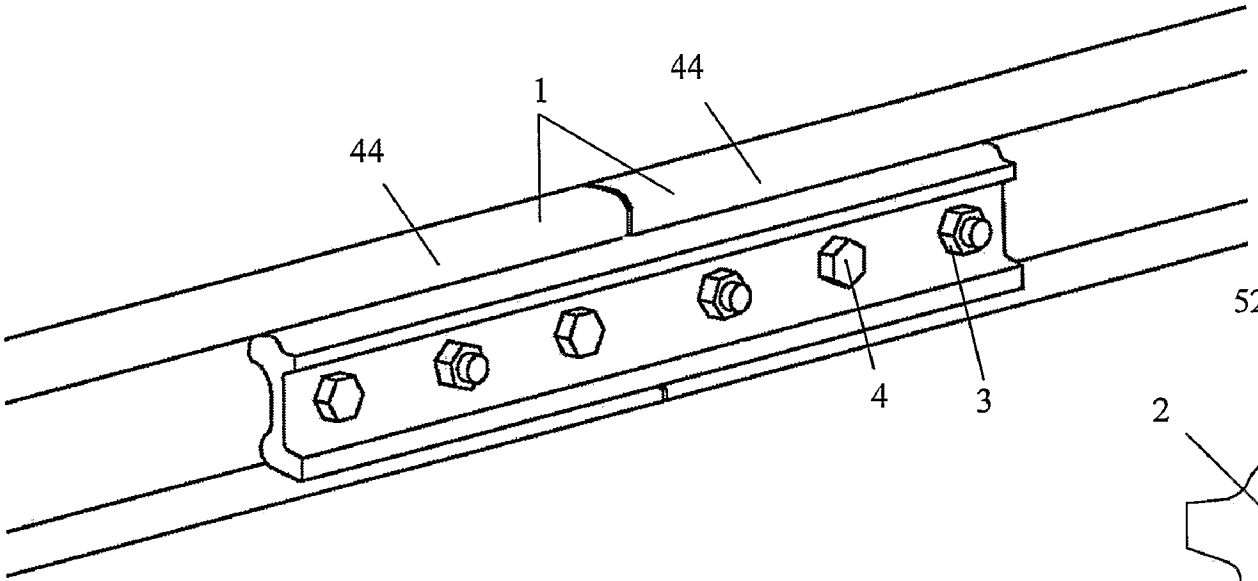
FIG. 1 is a perspective view of a prior art non-insulated joint system joining two rails.
Figure 2A:
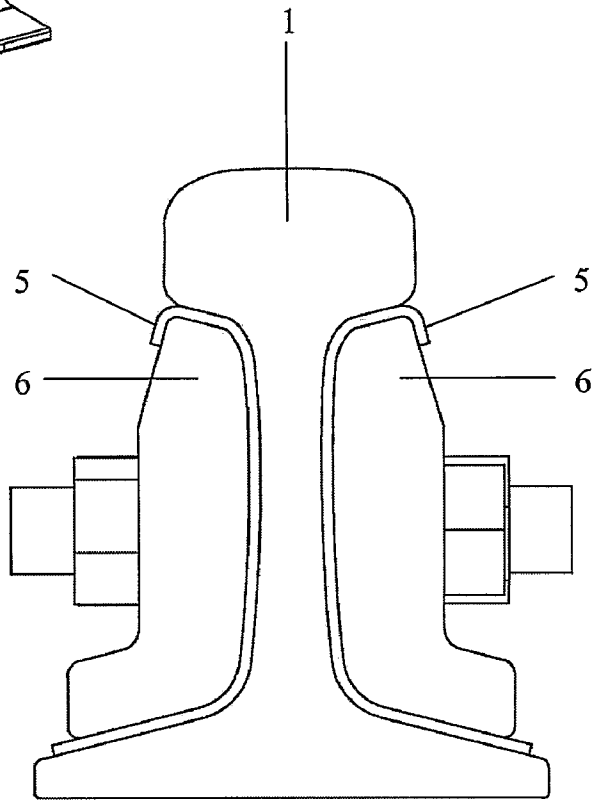
FIG. 2*a* is a cross sectional view of the joint system shown in FIG. 2.
Figure 2:
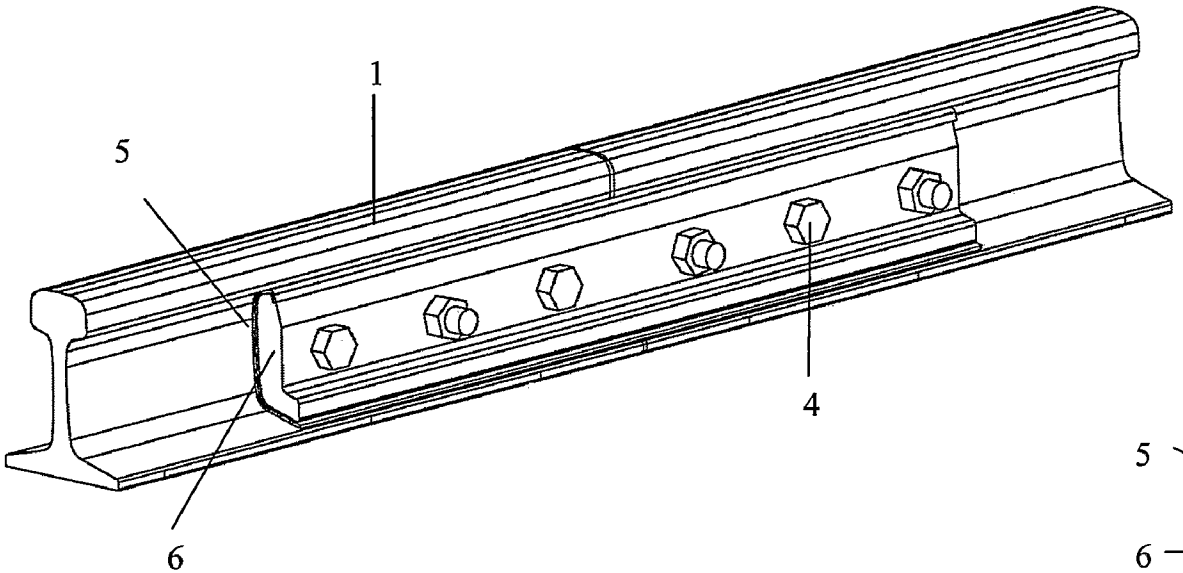
FIG. 2 is a perspective view of a prior art insulated joint system joining two rails.
Figures 3A, 3B, 3C:
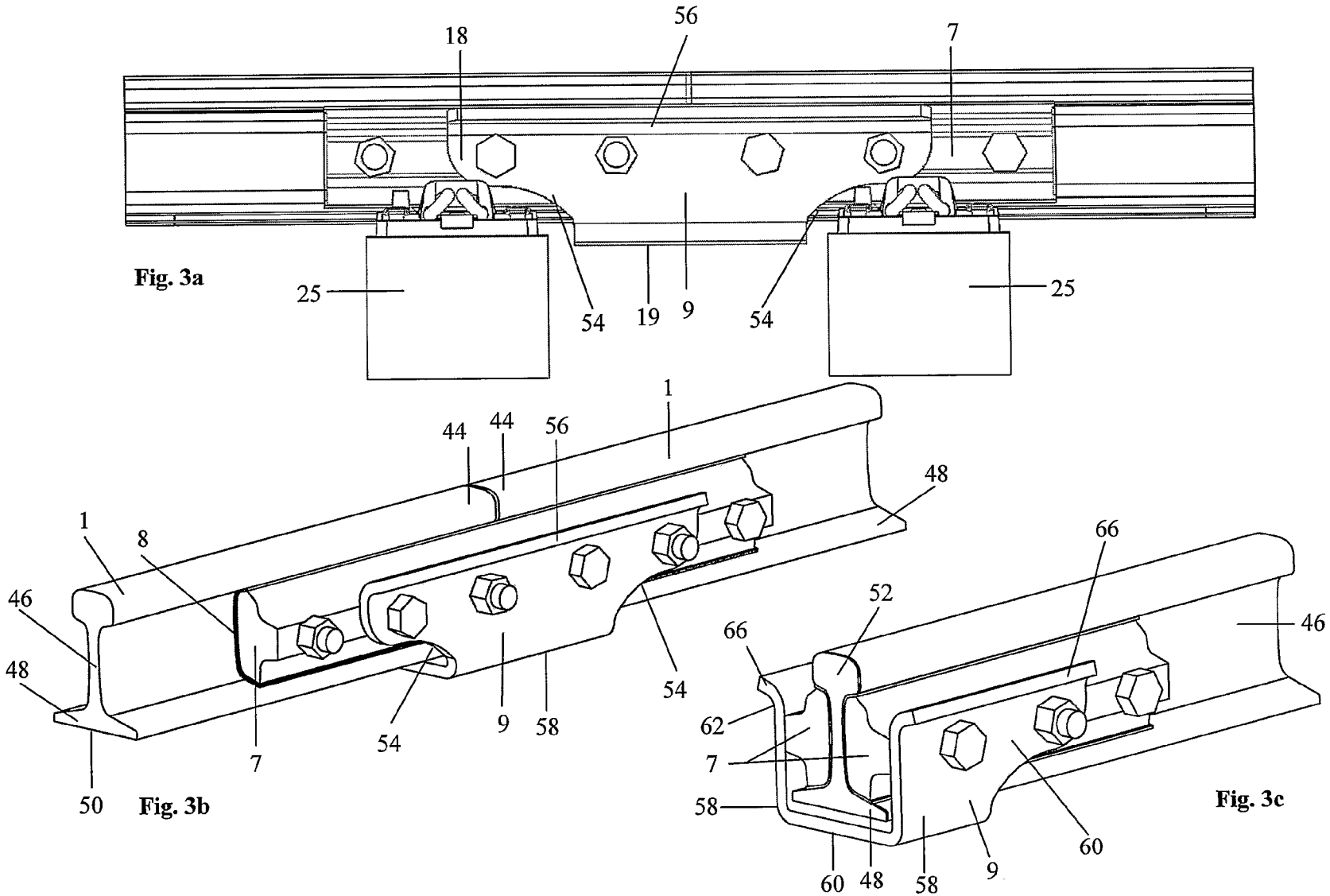
FIG. 3*a* is a side view of a joint system made in accordance with the present invention joining two rails.
FIG. 3*b* is a perspective view of the joint system shown in FIG. 3*a*.
FIG. 3*c* is a perspective view, partly in cross section, of the joint system shown in FIG. 3*b*.

Referring firstly to FIGS. 3*a* to 3*c* the present invention is directed at a joint assembly for joining rails 1 together in coaxial alignment at their abutting ends 44 between railway ties 25. Rails 1 each have head portion 52, web portion 46, toe portion 48 and bottom surface 50. This present invention provides a strengthen railway joint including two new joint bars (7), two insulators (8) between the rail (1) and the joint bars (7) and a stiffener (9) that attaches to the joint assembly to increase the stiffness. Stiffener 9 has stiffener parallel stiffener plates 60 and 62 having top edges 56, bottom edge 58 and lower ends 54. Lower ends 54 are notched such that the lower edge of the stiffener clears railway ties 25. As can be seen from the figures, joint bars 7 are attached to web portion 46 of rails 1 and span the joint between the two rails. Joint bars 7 are attached to the web on opposite sides of the web such that the web portion of the rails are sandwiched between the joint bars. The joint bars are dimensioned and configured to fit against the web portion of the rails between toe portion 48 and head portion 46.

Stiffener 9 is dimensioned and configured such that parallel stiffener plates 60 and 62 can be mounted to joint bars 7 such that the joint bars and the web of the rails are sandwiched between stiffener plates 60 and 62. The lower edges 58 of parallel plates 60 and 62 extend below toe portion 48 of rails 1. Connector portion 60 joins lower edges 58 of parallel stiffener plates 60 and 62 such that the stiffener 9 forms a continuous U shaped bracket. Parallel stiffener plates 60 and 62 have transverse portions 66 extending transversely away from rail 1. The object of the stiffener is to increase the stiffness of the joint and reduce the stresses in the insulating material by redistributing it to other parts of the joint system. The increased stiffness also means a reduction in the deflection of the joint. This reduces the pumping action at the joint. The increased stiffness is achieved in part by extending the lower edges of parallel plates 60 and 62 below toe portion 48 of the web. Transverse portions 66 add additional transverse stiffness to the joint.

Figure 4A:
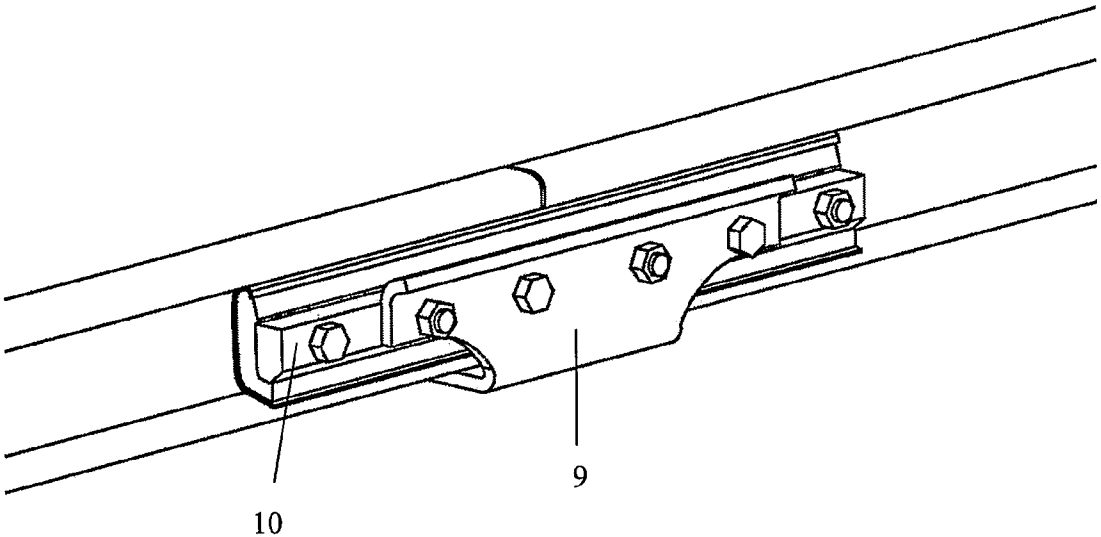
FIG. 4*a* is a perspective view of an alternate embodiment of the present invention joining two rails.
Figure 4B:
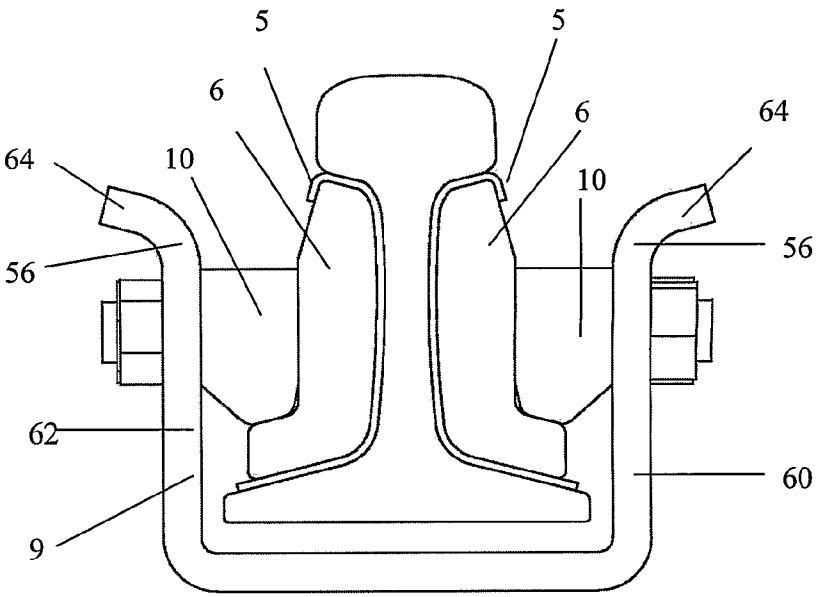
FIG. 4*b* is a cross-sectional view of the embodiment shown in FIG. 4*a*.
Figure 5A:
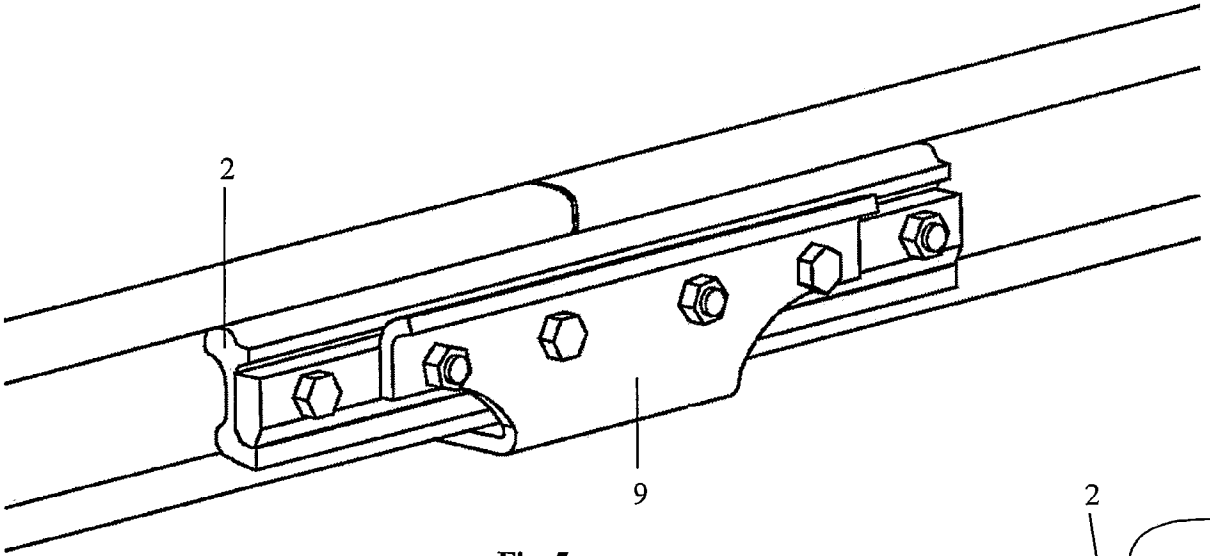
FIG. 5*a* is a perspective view of an alternate embodiment of the present invention joining two rails.
Figure 5B:
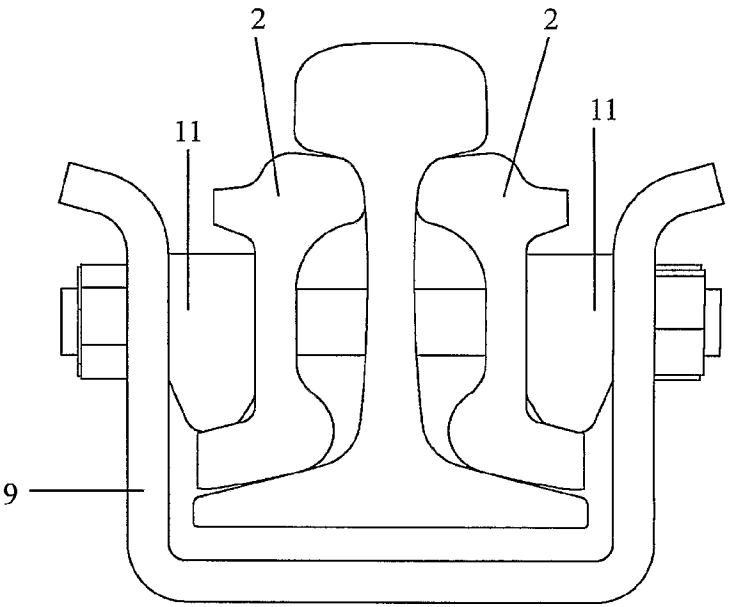
FIG. 5*b* is a cross-sectional view of the embodiment shown in FIG. 5*a*.

An alternative (FIGS. 4*a* and 4*b*) for an insulated joint assembly consists of two joint bars (6), two insulators (5), two spacer bars (10) and stiffener (9) is presented. This concept is also extended to a non-insulated joint in FIGS. 5*a* and 5*b*. In FIGS. 5*a* and 5*b*, the non-insulated joint assembly consists of two joint bars (2), two spacer bars (11) and stiffener (9). The object of the stiffener is to increase the stiffness of the joint and reduce the stresses in the insulating material by redistributing it to other parts of the joint system. The increased stiffness also means a reduction in the deflection of the joint. This reduces the pumping action at the joint.

Figure 6B:
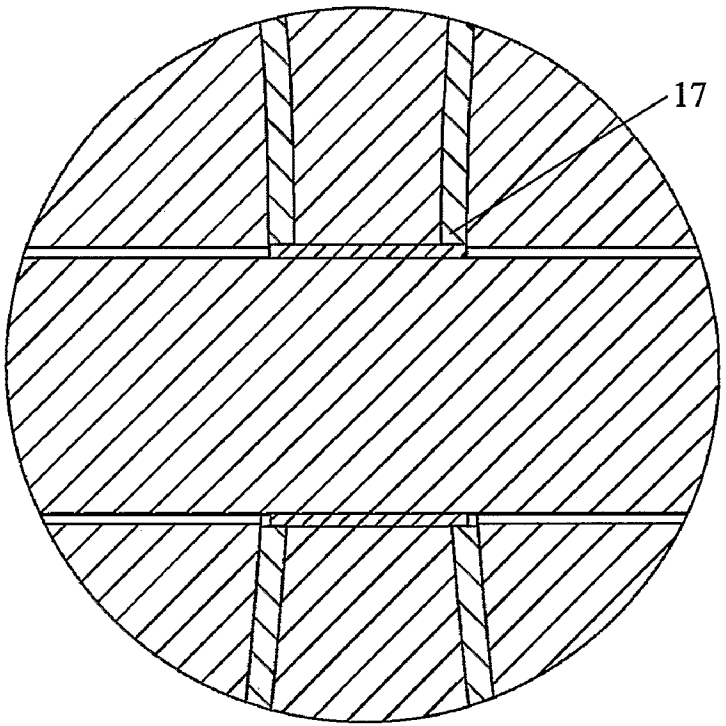
FIG. 6*b* is a detailed view of a portion of FIG. 6*a*.
Figure 6A:
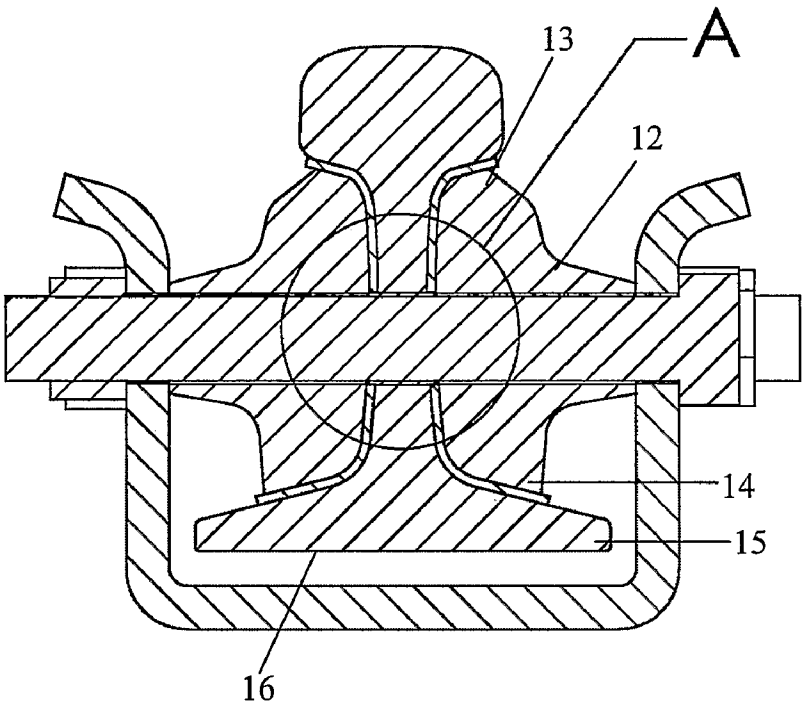
FIG. 6*a* is a cross-sectional view of a rail joining system made in accordance with the present invention.
Figure 7:
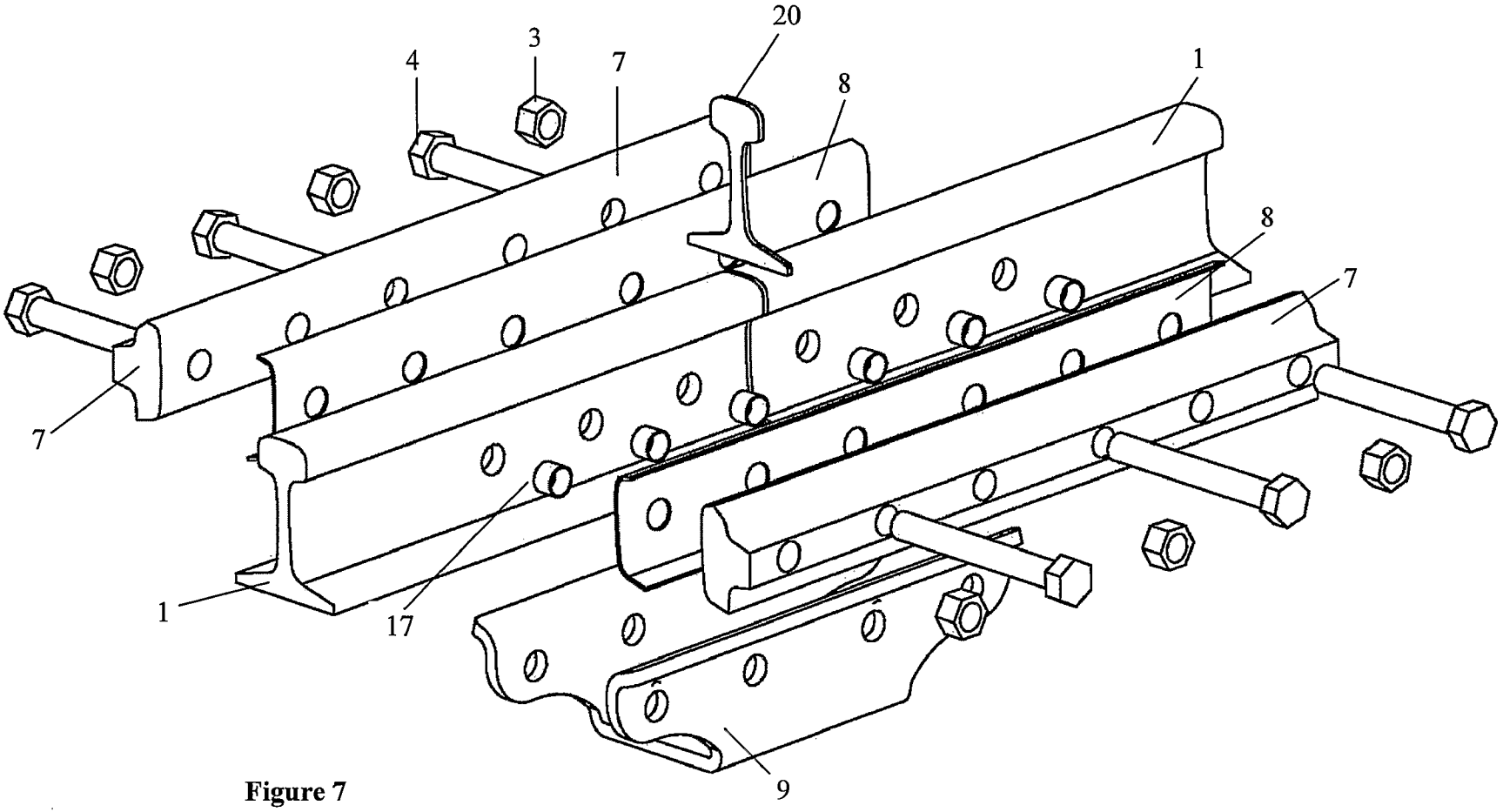
FIG. 7 is an exploded view of the invention shown in FIG. 3*a*.

A key element of the joint assembly design is the new joint bar (7). Looking at the transverse section of a joint (FIGS. 6*a* and 6*b*), it can be seen that the mid height (12) of the bar is substantially thicker than the top (13) and bottom (14). This is contrary to conventional joint bar designs where it is desirable to place more material at the upper and lower extremities of the joint bar for improved strength. The mid height (12) in the new joint bar is intentionally designed to protrude laterally such that when in an installed position, it extends laterally beyond the edges of the rail base (15). In addition to strengthening the joint, protrusion (12) of the joint bar (7) helps to ensure that when the stiffener (9) is installed, the vertical walls will clear the edges of the rail based (15) to avoid short-circuiting the signals in the two rails. Referring now to FIG. 7, the bolts (4) are also electrically isolated from the rail (1) by means of cylindrical insulators (17) inserted into the web of the rail. The bolts (4) then fit through the cylindrical insulators (17). Between the two rails is an end post (20) that prevents the ends of the rails from touching each other.

Figure 8B:
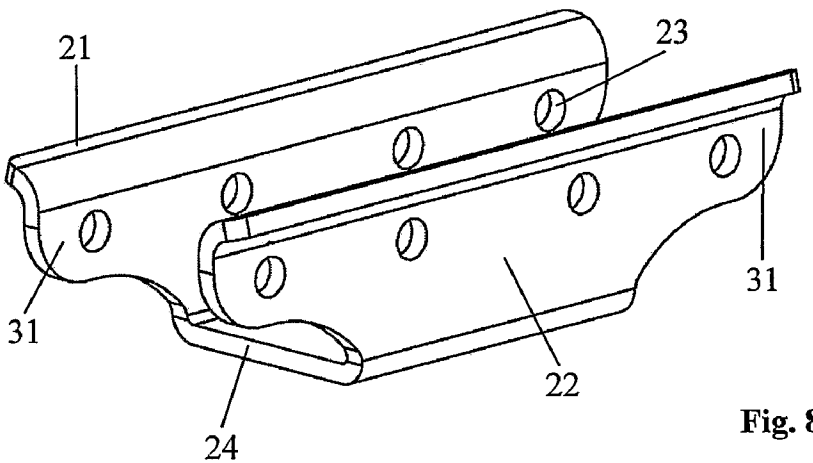
FIG. 8*b* is a perspective view of the stiffener portion of the embodiment shown in FIG. 8*a*.
Figure 8A:
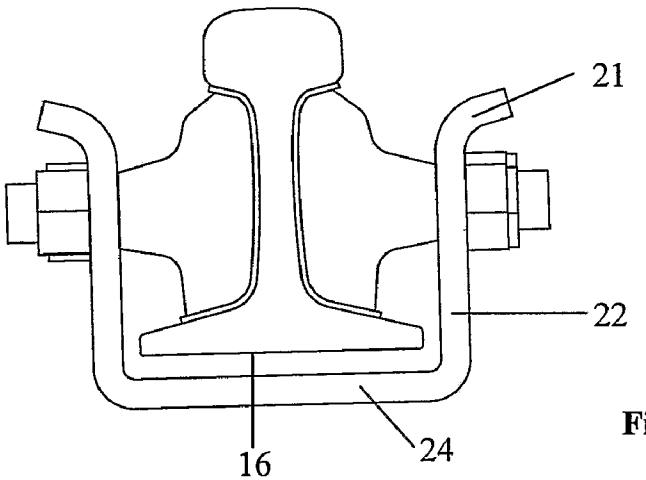
FIG. 8*a* is a cross-sectional view of a rail joining system made in accordance with the present invention.

In a preferred embodiment, the stiffener is a "U" shaped plate formed piece (9) shown in FIGS. 3*a*, 3*b* and 3*c*. From a side view of the assembly in FIG. 3*a*, it can be seen that the depth of the stiffener (9) is least at the ends (18) increasing towards the mid-span (19) of the stiffener. It is also a feature that is present in all the different stiffener shapes that are contained in this patent. In the preferred system (FIGS. 8*a* and 8*b*), the upper portion (21) of the stiffener is bent transversely outward to provide a surface for anchoring and lifting the joint during track tamping. The laterally bent upper transverse portion (21) also provides lateral stiffening of the joint should the joint be subjected to lateral loading. The intermediate portion (22) of the stiffener consists of two parallel plates with longitudinally arranged holes (23) made through them to accommodate the bolts (4) used to secure the joint. The depth of the walls contributes significantly to the vertical stiffness of the joint. The deeper the mid-span portions of the stiffener, the stiffer the joint. The mid-span of the intermediate portion (24) of the stiffener extends below the bottom surface of the rail base (16). This mid-span of the intermediate portion (24) is also located between the ties (25). In the preferred embodiment, the lower portion (24) which also lies between the two ties (25) connects the two walls that form the intermediate portion to form an open box with the open end facing upwards. The entire stiffener (9) can be made from one plate that is bent into the open box shape. Alternatively, the lower portion (24) can also be made by welding a plate to the intermediate portion (22).

Figure 9B:
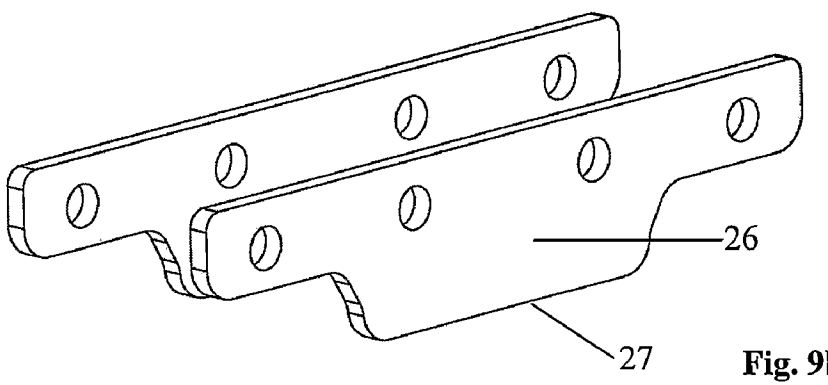
FIG. 9*b* is a perspective view of the stiffener portion of the embodiment shown in FIG. 9*a*.
Figure 9A:
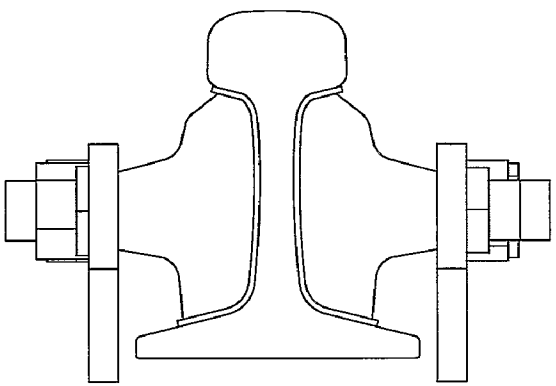
FIG. 9*a* is a perspective view of an alternate embodiment of the rail joining system made in accordance with the present invention.

An alternative form of joint stiffening is achieved with flat stiffener plates (26) that are cut into the shape shown in FIGS. 9*a* and 9*b*. Again, the depth of the stiffener is substantially increased in the mid-span area lower edge (27) that fits between the ties than at the lower ends (31) that lie above the railway ties.

Figure 10B:
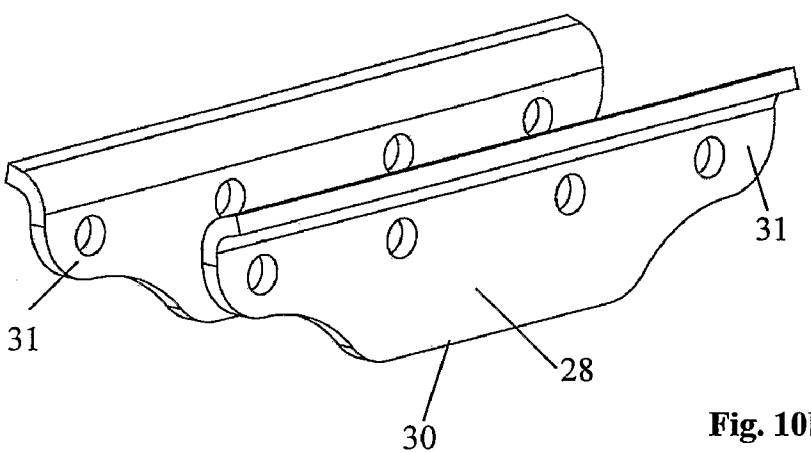
FIG. 10*b* is a perspective view of the stiffener portion of the embodiment shown in FIG. 10*a*.
Figure 10A:
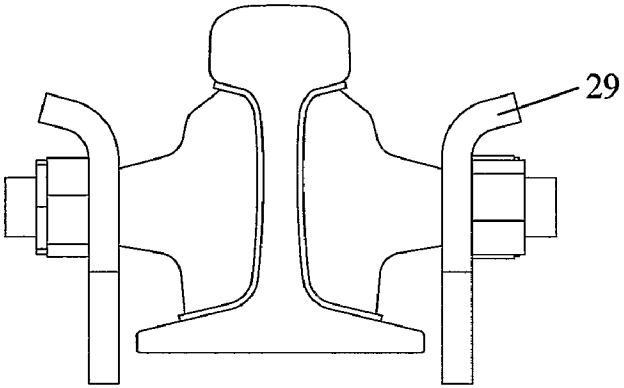
FIG. 10*a* is a perspective view of an alternate embodiment of the rail joining system made in accordance with the present invention.

Another form of joint stiffening is achieved with bent plates (28) that are cut into the shape shown in FIGS. 10*a* and 10*b*. In this option, the upper portion (29) is bent laterally outwards to provide a surface for grabbing and lifting the joint during track tamping and lateral stiffening of the joint. Again, the depth of the stiffener is substantially increased in the middle portion (30) that fits between the ties (25) than at the ends (31) that lie above the ties (25).

Figure 11B:
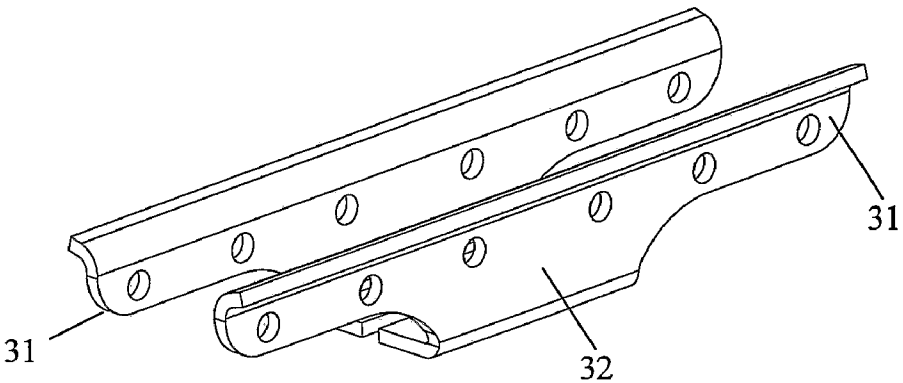
FIG. 11*b* is a perspective view of the stiffener portion of the embodiment shown in FIG. 11*a*.
Figure 11A:
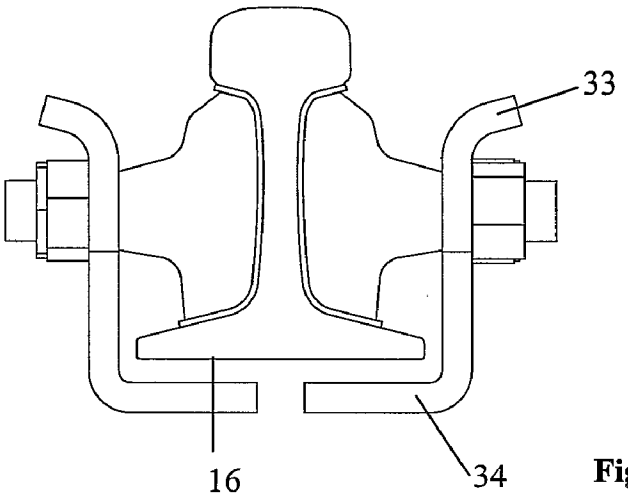
FIG. 11*a* is a perspective view of an alternate embodiment of the rail joining system made in accordance with the present invention.

Another form of joint stiffening is achieved with bent plates (32) that are cut and bent into the shape shown in FIGS. 11*a* and 11*b*. In this option, the upper portion (33) is bent laterally outwards to provide a surface for grabbing and lifting the joint during track tamping and to stiffen the joint. The lower portion (34) is bent laterally inwards to lie beneath the rail base (16). Again, the depth of the stiffener is substantially increased in the middle portion (32) that fits between the ties (25) than at the ends (31) that lie above the ties (25). The laterally inwardly bent portion (34) only lies between the ties.

Figure 12B:
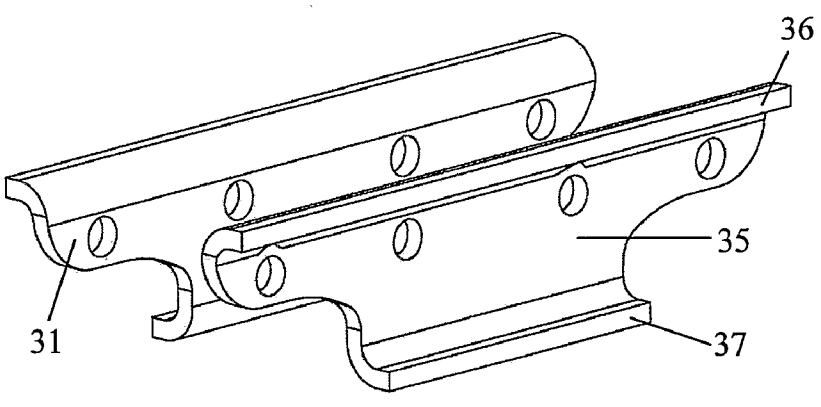
FIG. 12*b* is a perspective view of the stiffener portion of the embodiment shown in FIG. 12*a*.
Figure 12A:
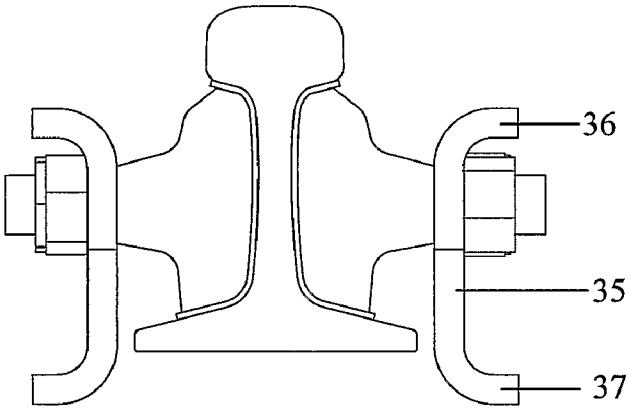
FIG. 12*a* is a perspective view of an alternate embodiment of the rail joining system made in accordance with the present invention.

Another form of joint stiffening is achieved with channel sections (35) that are cut into the shape shown in FIGS. 12*a* and 12*b*. In this option, the upper portion (36) is bent laterally outwards to provide a surface for grabbing and lifting the joint during track tamping. The lower portion (37) is bent laterally outward away from the rail base (16) to form a channel shape. Again, the depth of the stiffener is substantially increased in the middle portion that fits between the ties (25) than at the ends (31) that lie above the ties (25).

Figure 13B:
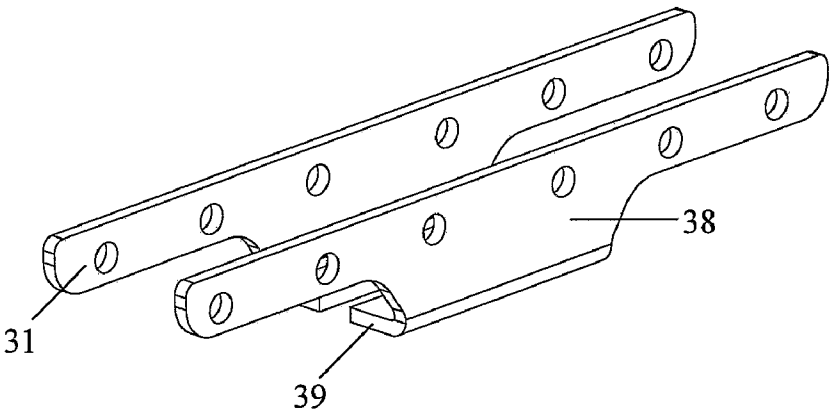
FIG. 13*b* is a perspective view of the stiffener portion of the embodiment shown in FIG. 13*a*.
Figure 13A:
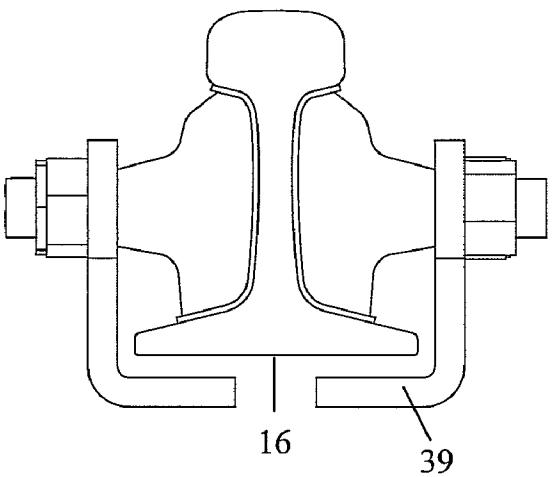
FIG. 13*a* is a perspective view of an alternate embodiment of the rail joining system made in accordance with the present invention.

Another form of joint stiffening is achieved by combining the stiffeners shown in Figures (38) that are cut into the shape shown in FIGS. 13*a* and 13*b*. In this option, the lower portion (39) is bent laterally inwardly under the rail base (16). Again, the depth of the stiffener is substantially increased in the middle portion (28) that fits between the ties than at the ends (31) that lie above the ties (25).

Figure 14B:
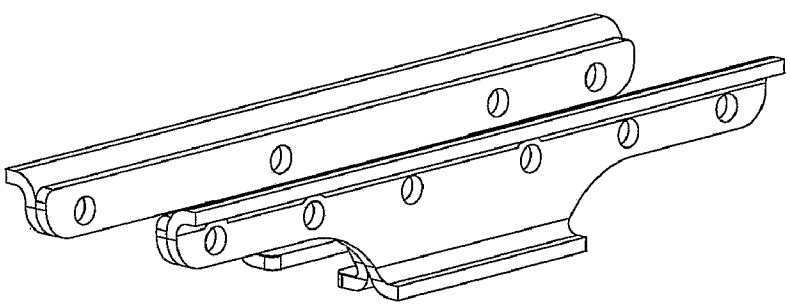
FIG. 14*b* is a perspective view of the stiffener portion of the embodiment shown in FIG. 14*a*.
Figure 14A:
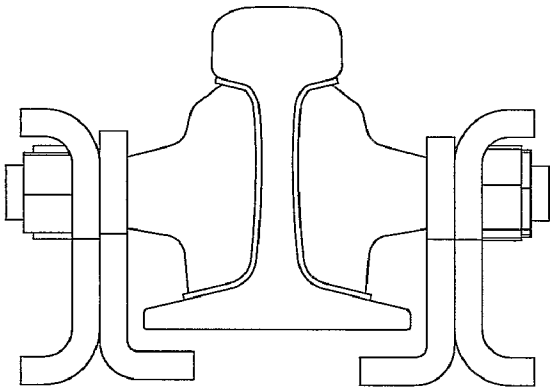
FIG. 14*a* is a perspective view of an alternate embodiment of the rail joining system made in accordance with the present invention.
Figure 15B:
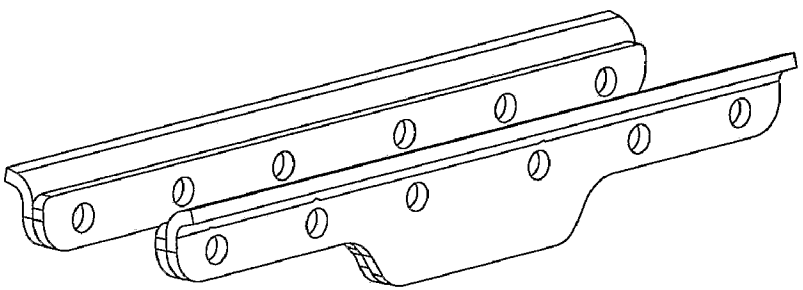
FIG. 15*b* is a perspective view of the stiffener portion of the embodiment shown in FIG. 15*a*.
Figure 15A:
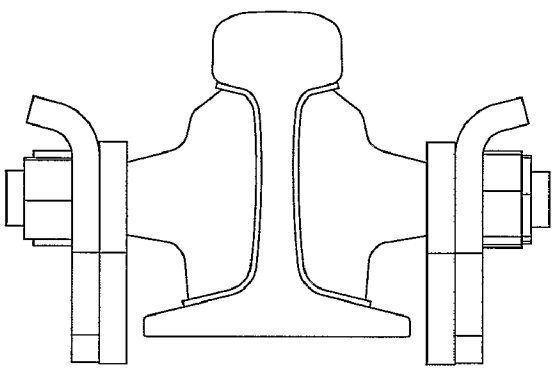
FIG. 15*a* is a perspective view of an alternate embodiment of the rail joining system made in accordance with the present invention.

FIGS. 14*a* and 14*b* show another embodiment that combines elements of the stiffener that are shown in FIGS. 12*a* and 13*a*. FIGS. 15*a* and 15*b* also show an option that combines elements of the stiffener that are shown in FIGS. 9 and 10. In any case, combinations of different elements do not negate the object of the invention.

Figure 16B:
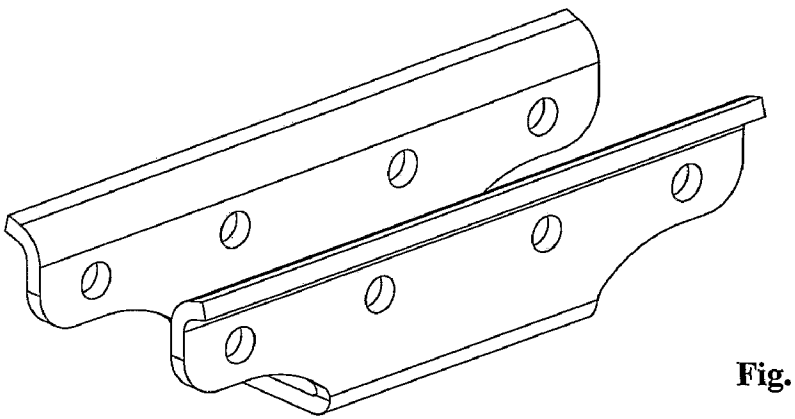
FIG. 16*b* is a perspective view of the stiffener portion of the embodiment shown in FIG. 16*a*.
Figure 16A:
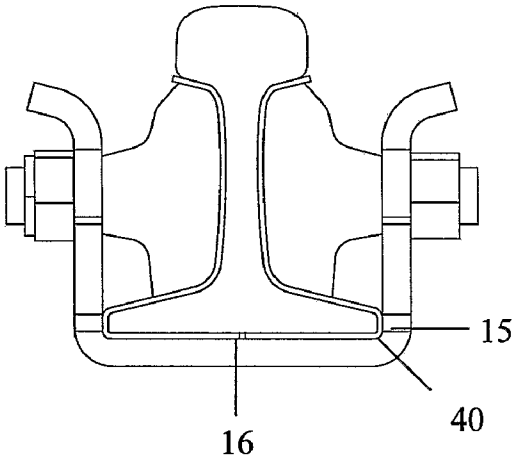
FIG. 16*a* is a perspective view of an alternate embodiment of the rail joining system made in accordance with the present invention.

FIGS. 16*a* and 16*b* show an embodiment of the joint assembly wherein insulating material (40) is placed along the edge of the rail base (15) and along the bottom surface (16) of the rail base to maintain signal isolation. In this option, the stiffener may or may not contact the insulator (40).

Figure 17B:
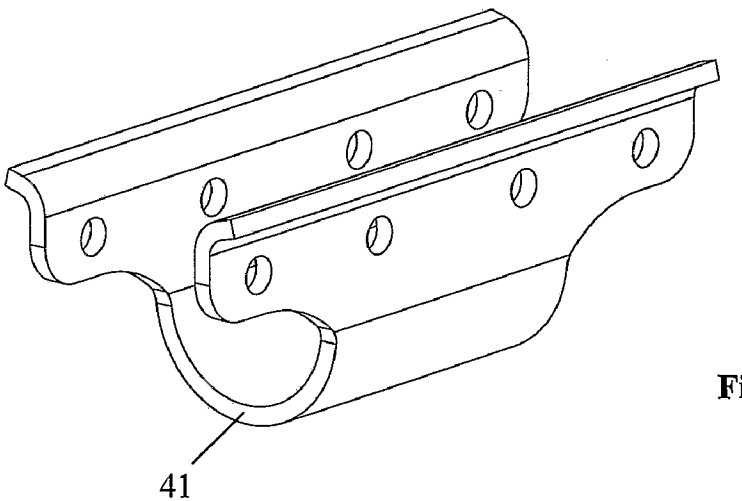
FIG. 17*b* is a perspective view of the stiffener portion of the embodiment shown in FIG. 17*a*.
Figure 17A:
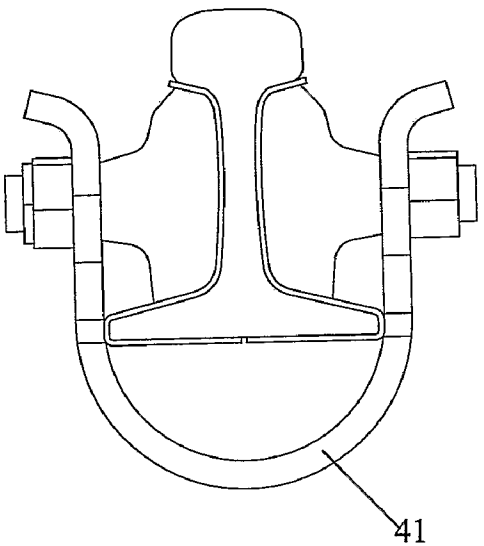
FIG. 17*a* is a perspective view of an alternate embodiment of the rail joining system made in accordance with the present invention.

FIGS. 17*a* and 17*b* show an embodiment of the joint assembly wherein the stiffener the lower portion (41) of the stiffener has the shape of a half moon.

Figure 18B:
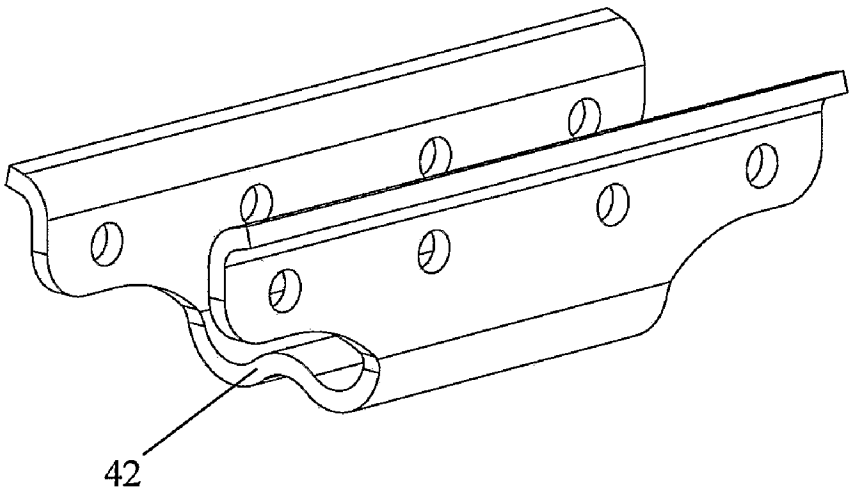
FIG. 18*b* is a perspective view of the stiffener portion of the embodiment shown in FIG. 18*a*.
Figure 18A:
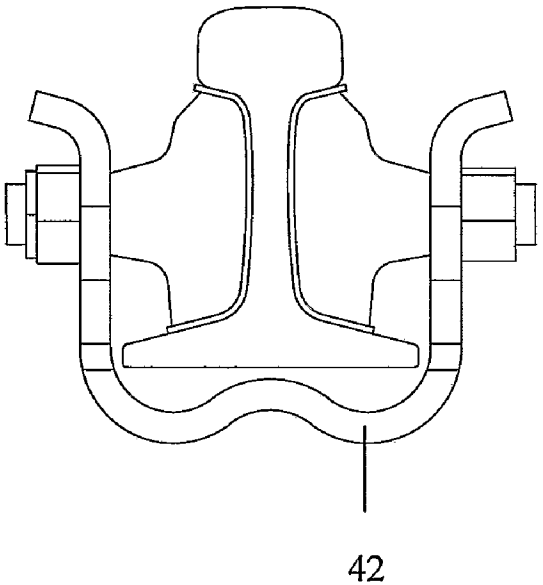
FIG. 18*a* is a perspective view of an alternate embodiment of the rail joining system made in accordance with the present invention.
Figures 19A, 19B, 19C, 19D, 19E:
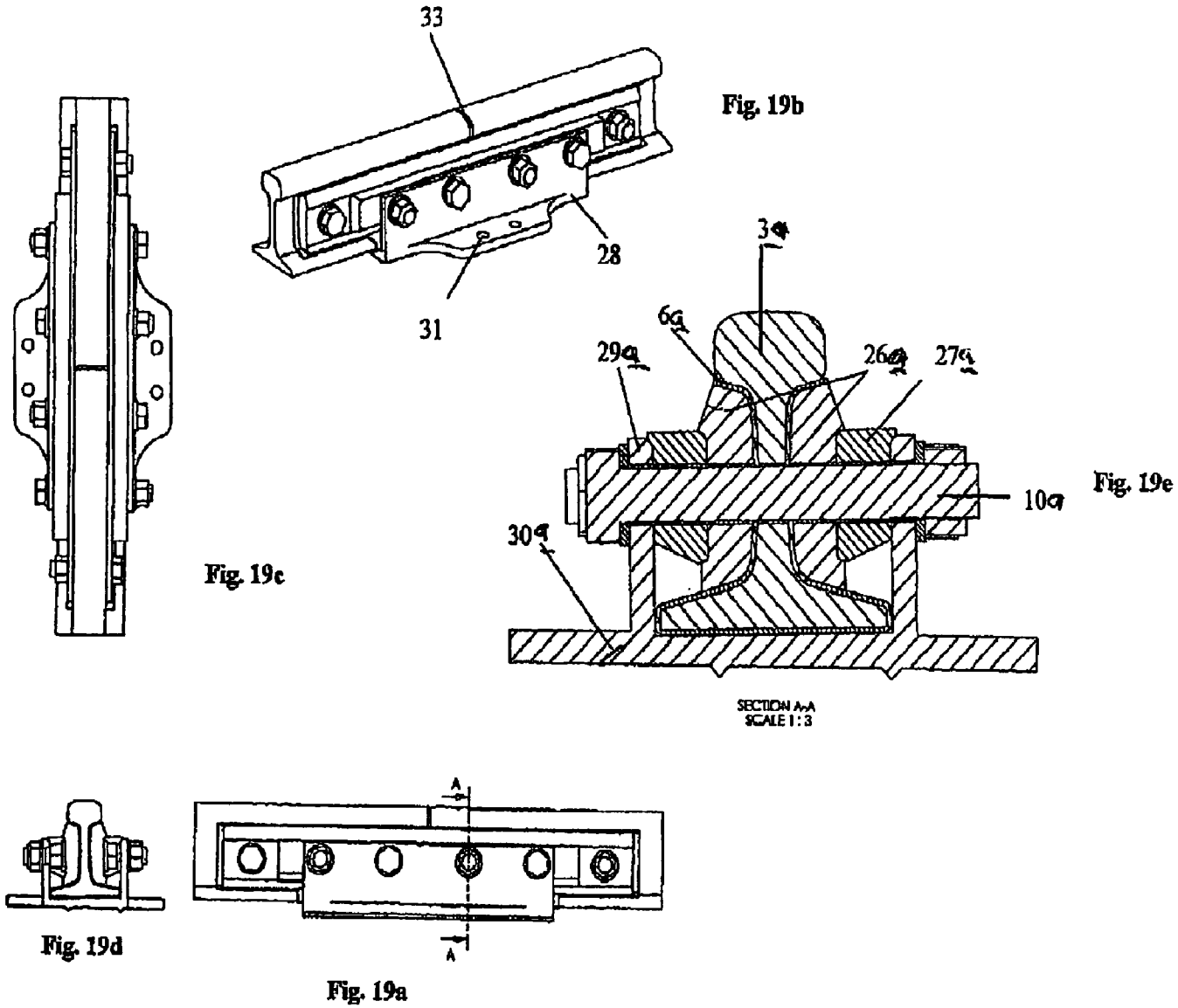
FIG. 19*a* is a side view of an alternate embodiment of the rail joint made in accordance with the present invention.
FIG. 19*b* is an isometric view of the rail joint shown in FIG. 6*a*.
FIG. 19*c* is top view of the rail joint shown in FIG. 6*a*.
FIG. 19*d* is a cross sectional view of the rail joint shown in FIG. 6*a*.
FIG. 19*e* is a cross sectional view taken along line A-A of FIG. 6*a*.

FIGS. 18*a* and 18*b* show an embodiment of the joint assembly wherein the stiffener the lower portion (42) of the stiffener is corrugated.

An alternative design (FIGS. 19*a* to 19*e*) describes a joint stiffener (28*a*) for a supported insulated joint assembly consists of two joint bars (26*a*), two spacer bars (27*a*) two insulators (6*a*) between the rail (3*a*), two joint bars (26*a*) and an inverted "Double-T" joint stiffener (28*a*) that serves as a tie plate and stiffener. The stiffener (28*a*) has a vertical wall (29*a*) rigidly connected to a canted horizontal plate section (30*a*). The entire assembly is connected together with bolts and nuts (10*a*). The plate portion of the stiffener has holes (not shown) for fastening the assembly to the tie (not shown).

Figure 21:
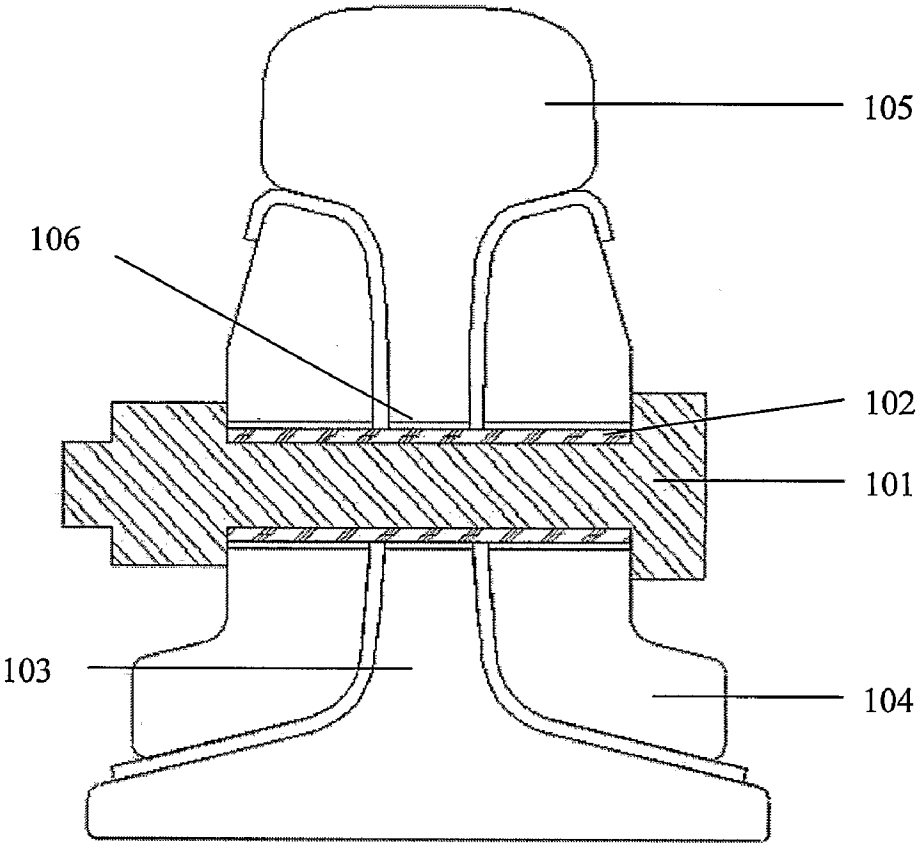
FIG. 21 is a cross sectional view of a the thimble bushing shown in FIG. 20 incorporated into and insulated railway joint.
Figure 20:
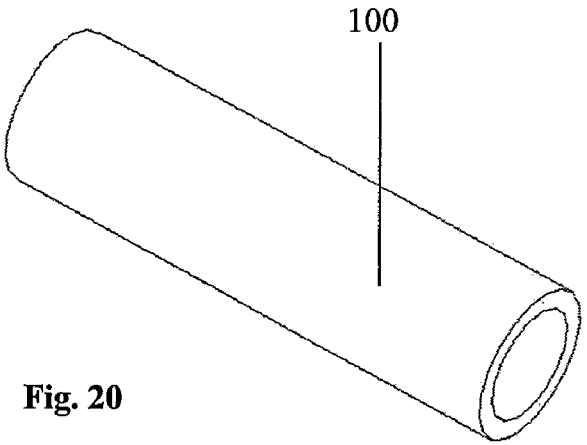
FIG. 20 is a perspective view of a prior art insulated thimble bushing.

Referring now to FIGS. 20 and 21, current insulated thimble bushings (100) are used to protect the bolts (101) from touching the rail in an insulated joint. These thimble bushings generally consist of non-conductive polymer tube (100) that is inserted through the joint bars (104) and rail (105) as shown in FIG. 21. Each thimble (100) is subjected to bearing loading on the surface that is in contact with the aperture (106) made through the web (103) of the rail. The bearing stress often exceeds the strength of the thimble material leading to premature failure of the thimble and loss of signal isolation. When one thimble on either sides of the joint has failed, the track signal is transmitted through one bolt on one rail and along the joint bars and through the second bolts to the other rail. This leads to signal failure in the system and urgent remedial maintenance action.

Figure 24:
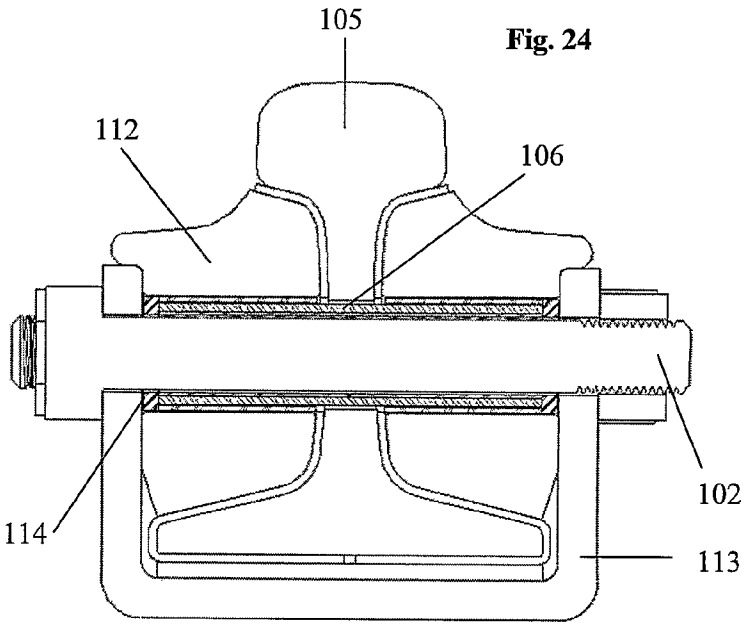
FIG. 24 is a cross sectional view of the thimble bushing shown in FIG. 22 incorporated into the an insulated joint made in accordance with the present invention.
Figure 22:
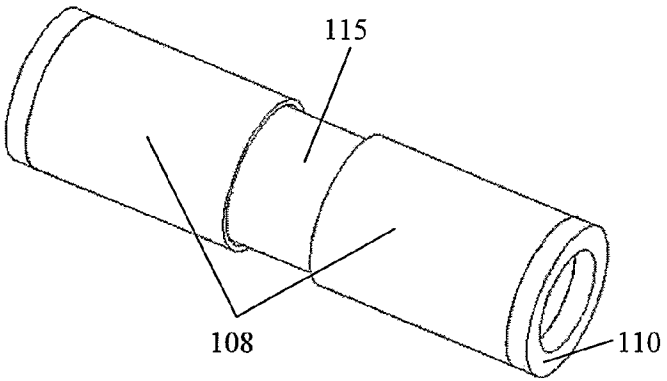
FIG. 22 is a perspective view of an insulated thimble bushing made in accordance with the present invention.
Figure 23:
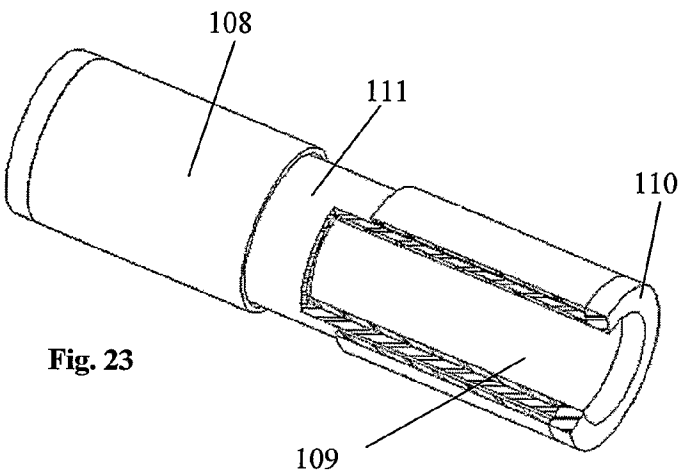
FIG. 23 is a partly cut out perspective view of the insulated thimble bushing shown in FIG. 22.

An improved design of the thimble bushing shown in FIGS. 22 to 24 and consists of an inner (109) and an outer (108) nonconductive polymer sleeve, a middle steel sleeve (111) and nonconductive polymer end caps (110). A cutaway of the system is shown in FIG. 23. The outer sleeve (108) partially house the metal sleeve (111) which in turn houses the inner polymer sleeve (109). The inner polymer sleeve (109) makes contact with the bolt (102). The middle portion of sleeve (108) has bare portion (115) which exposes the metal sleeve and enables the metal sleeve to make physical contact with the hole the web (107) of the rail (105). The sleeves and apertures are dimensioned and configured such that the metal sleeve (111) makes sufficiently strong physical contact with web (107) that the metal sleeve (111) distributes the load from the rail (105) to the inner polymer sleeve (109). This significantly reduces the stresses in the inner sleeve (109) that is in contact with the blot (102). The metal sleeve (111) also acts as a stiffener that reduces the amount of bending deformation sustained by the blot (102). The outer polymer sleeves (108) protect the metal sleeve (111) from touching the joint bars (112). The exposed ends of the metal sleeve are insulated from touching the joint saddle (113) with polymer caps (110).

A specific embodiment of the present invention has been disclosed; however, several variations of the disclosed embodiment could be envisioned as within the scope of this invention. It is to be understood that the present invention is not limited to the embodiments described above, but encompasses any and all embodiments within the scope of the following claims.

I claim:

1. A joint assembly for joining together abutting ends of two coaxially aligned rails (1) between two railway ties (25), the rails having a head portion (52), a web portion (46) and a toe portion (48), the assembly comprising: first and second elongated metal joint bars (7) for holding the abutting ends of the rails together, the joint bars spanning the ends of the rails, the joint bars being mounted to each rail on opposite sides of the web portions of each rail, the joint bars configured to mount to the web portions of the rail between the head and toe portion of each rail, first (60) and second (62) stiffener plates mounted to the first and second joint bars, respectively, such that the joint bars and the web portion of the rails are sandwiched between the stiffener plates, the stiffener plates each having a top edge (56), a bottom portion (58) and opposite lower ends (54), the stiffener plates spanning the abutting ends of the rail, the bottom portion of the stiffener plates extending below the toe portion of the rails, the opposite lower ends of the stiffener plates being notched to accommodate the ties where the stiffener plates comprise a single U shaped bracket having a pair of elongated parallel portions and a connecting portion, the parallel portions being mounted to the joint bars, the connection portion extending below the toe of the rails and where insulated thimble bushings are used to protect the bolts from touching the rail in an insulated joint where said thimble bushings consist of a non-conductive polymer tube that is inserted through the joint bars and rail.

2. The joint assembly of claim 1 wherein the upper edges of the stiffener plates extend outwardly away from the rails.

3. The joint assembly of claim 1 wherein a portion of the lower edges of the stiffener plates extend perpendicularly towards and below the rails.

4. The joint assembly of claim 1 wherein a portion of the lower edges of the stiffener plates extend perpendicularly away from the rails.

5. The joint assembly of claim 1 wherein the parallel portions each have an upper edge, the upper edges of the parallel portions extending perpendicularly away from the rail.

6. The joint assembly of claim 1 wherein the connecting portion is flat.

7. The joint assembly of claim 1 wherein the connecting portion is arcuate.

8. The joint assembly of claim 1 wherein the connection portion includes an elongated groove extending parallel to the rails and below the rails.

9. The joint assembly of claim 1 wherein the joint bam have an elongated protruding ridge extending the length of the bar, the ridge oriented away from the rail.

10. The rail joint of claim 1 wherein the apertures, the inner, outer and middle sleeves and the bare portion are dimensioned and configured such that the middle sleeve receives loading forces from the rail and distributes it to the inner and outer sleeves.

11. The rail joint of claim 1 wherein the middle sleeve has opposite ends and the opposite ends are encapsulated with polymer caps.

* * * * *